United States Patent [19]

Hoffman

[11] Patent Number: 4,988,255

[45] Date of Patent: Jan. 29, 1991

[54] UNPACKAGING MACHINE

[75] Inventor: Dalyn C. Hoffman, Augusta, Mich.

[73] Assignee: The Upjohn Company, Kalamazoo, Mich.

[21] Appl. No.: 314,041

[22] Filed: Feb. 22, 1989

[51] Int. Cl.[5] ..... B65G 65/23

[52] U.S. Cl. ..... 414/412; 414/416; 414/418

[58] Field of Search ..... 414/403, 404, 411, 412, 414/416, 418, 419

[56] References Cited

U.S. PATENT DOCUMENTS

| | | | |
|---|---|---|---|
| 1,902,612 | 3/1933 | Blossom et al. | 414/411 |
| 2,386,152 | 10/1945 | Wahl | 414/404 X |
| 2,438,050 | 3/1948 | Hansen | 414/411 |
| 3,487,965 | 1/1970 | Gale | 414/412 X |
| 3,651,751 | 3/1972 | Randrup | 414/411 X |
| 3,870,175 | 3/1975 | DiIanni | 414/411 |
| 4,228,864 | 10/1980 | Berger et al. | 414/411 X |
| 4,475,860 | 10/1984 | Okamoto et al. | 414/416 |
| 4,732,057 | 3/1988 | Tamura et al. | 414/411 X |
| 4,782,967 | 11/1988 | Thomas | 220/279 X |

FOREIGN PATENT DOCUMENTS

| | | | |
|---|---|---|---|
| 1929112 | 1/1971 | Fed. Rep. of Germany | 414/411 |
| 2403659 | 8/1974 | Fed. Rep. of Germany | 414/411 |
| 2841921 | 1/1980 | Fed. Rep. of Germany | 414/411 |
| 1012915 | 12/1965 | United Kingdom | 414/418 |

*Primary Examiner*—Robert J. Spar
*Assistant Examiner*—John VandenBosche
*Attorney, Agent, or Firm*—Flynn, Thiel, Boutell & Tanis

[57] ABSTRACT

An unpackaging machine is disclosed that respectively removes the cap, seal, cotton wad and tablets from a package container. The unpackaging machine includes a turntable with slots for receiving and transporting the sealed container, a rotatable chuck for removing the cap from the sealed container, a rotatable knife for rupturing the seal on the container, a gripper for removing the cottom wad and seal from the container, inverting guide rails for emptying the contents of the container, and an outlet for discharging the emptied container.

19 Claims, 4 Drawing Sheets

UNPACKAGING MACHINE

FIELD OF THE INVENTION

This invention pertains to a recovery of the contents of a sealed container and, in particular, to the recovery of pharmaceutical substances in a capped bottle having a seal and a cotton wad contained therein.

BACKGROUND OF THE INVENTION

During the manufacturing and packaging of pharmaceuticals, occasions arise where it is necessary to recover the pharmaceutical substances from a sealed container such as a capped bottle. These occasions typically occur when there is a defect in the pharmaceutical substance or there is a visual defect in the sealed container or the information on the label on the sealed container is incorrect.

Although there are many devices for the packaging and the sealing of a pharmaceutical product into a container, the usual method of the removal of the pharmaceutical product from the sealed container is by hand, e.g., by decapping the sealed container, perforating the seal, and pouring out the contents. This procedure is not only laborious and often unpleasant, but potentially hazardous. By providing an apparatus that can automatically open a sealed container and empty the contents therein, the work of removing the pharmaceutical product can be done more safely and efficiently.

U.S. Pat. No. 4,573,852 discloses an apparatus for rupturing a plastic bottle or vessel in order to recover their contents. This apparatus comprises a rupturing member, means for locating a bottle or vessel to be ruptured, means for limiting the movement of the bottle or vessel and means for moving the limiting means and the rupturing member relative to one another whereby to rupture the bottle or vessel. However, this apparatus has the drawbacks that the bottle or vessel is destroyed and there is a high probability that the pharmaceutical product will be contaminated by bits of the ruptured container.

U.S. Pat. No. 4,428,709 shows an apparatus for recovering the contents of a "blister" package in ribbon form, which comprises the means for puncturing the outline of an egress hole in the base of a blister pack and means for impinging upon the top of the blister pack to force the contents thereof through the egress hole. While this apparatus may be effective in recovering the contents of a blister pack, it has no utility whatsoever with respect to the recovery of the contents of a capped container having a seal, a cotton wad and a pharmaceutical product contained therein.

U.S. Pat. No. 3,744,214 discloses a machine for stripping capsules from a strip package having a backing sheet and a pocket sheet. This machine uses a roller for contacting with the backing sheet and another roller for contacting with the pocket sheet. The rollers are driven in opposite directions to advance a strip package through them and rupture the pockets in the pocket sheet to thereby release the capsules. However, this reference also has no utility in the removal of a pharmaceutical product from a capped container having a seal, a cotton wad and a pharmaceutical product contained therein.

Accordingly, it is an objective of the present invention to provide an unpackaging machine that can empty the contents of a sealed container and dispose of the emptied sealed container with minimal human intervention.

It is a further object of the invention to provide an apparatus, as aforesaid, which collects the component parts of the sealed container in separate locations.

It is a further object of the invention to provide an apparatus, as aforesaid, which is of a durable construction involving little or no maintenance.

SUMMARY OF THE INVENTION

The objects and purposes of the present invention are met by providing an apparatus for removing the cap from a sealed container, rupturing a seal in the sealed container, removing the ruptured seal and a wad of cotton from the container, inverting the container so as to empty the contents thereof, and disposing of the emptied container. In addition, a device is provided which includes a means for receiving and transporting a sealed container, means for removing a cap from the sealed container, means for rupturing the seal on the sealed container, means for removing the cotton wad and the ruptured seal from the sealed container, means for emptying the contents from said container, and means for discharging the emptied container.

BRIEF DESCRIPTION OF THE DRAWINGS

An embodiment of the present invention will now be described, by way of example, with reference to the accompanying drawings, in which.

DESCRIPTION OF THE PREFERRED EMBODIMENTS

Figure 1:
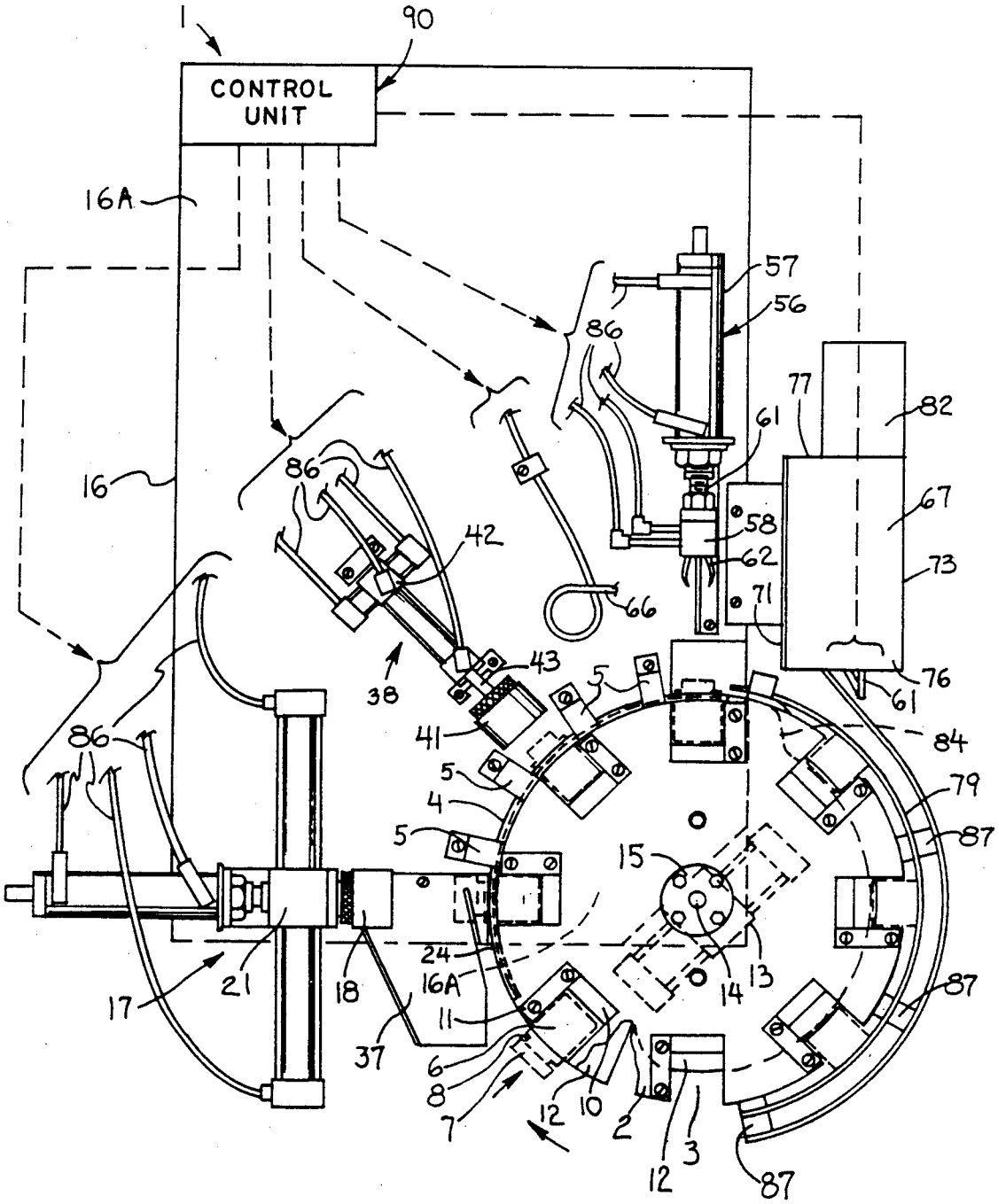
FIG. 1 is a top plan view of an embodiment of this invention.

Referring first to FIG. 1, there is illustrated a device which embodies the present invention. The unpackaging machine 1 of the present invention comprises a circular, indexable turntable 2 having a plurality of slots 3 provided therein. The slots 3 are sized to accommodate the sealed container 6 to be emptied and can be varied in size by the use of a back shim 10 and a side shim 11. The back shim 10 and side shim 11 can be secured in the slots 3 by any securing means such as brackets, screws or bolts. The material of construction of the turntable 2 and shims 10, 11 are not critical and any suitable material may be used.

A stationary shelf 12, such as sheet metal shelf having a smooth upper surface, is provided underneath the turntable 2 and serves as a means for providing a support surface for the sealed containers 6 during their transport through the various unpackaging operations. The stationary shelf 12 is fixedly secured to the top of a base member 16. The base member 16 has an upwardly facing flat planar support surface 16A, such as the top of a table, and serves in general as the supporting structure for the various components of the unpackaging machine.

A drive unit 13 is mounted on the underside of the stationary shelf 12 and has a drive shaft 14 extending upwardly through an opening (not shown) provided in the stationary support shelf 12. The drive unit 13 can be any suitable drive means capable of imparting indexing motion to the turntable 2, such as a Rotary Indexer by Rotomation Incorporated of Daytona Beach, Fla. A drive flange 15 on the drive unit 13 is bolted onto the turntable 2 and keyed to the drive shaft 14 and connects the turntable 2 with the drive unit 13. The drive unit 13 turns the turntable clockwise 45 degrees in a stepwise fashion. After turning the turntable 45 degrees, a control unit 90 causes the drive unit 13 to pause for a predetermined period of time before again indexing the turntable 45 degrees. The length of time for the pause between indexing is determined by the unpackaging operation which takes the longest period of time.

Figure 2:
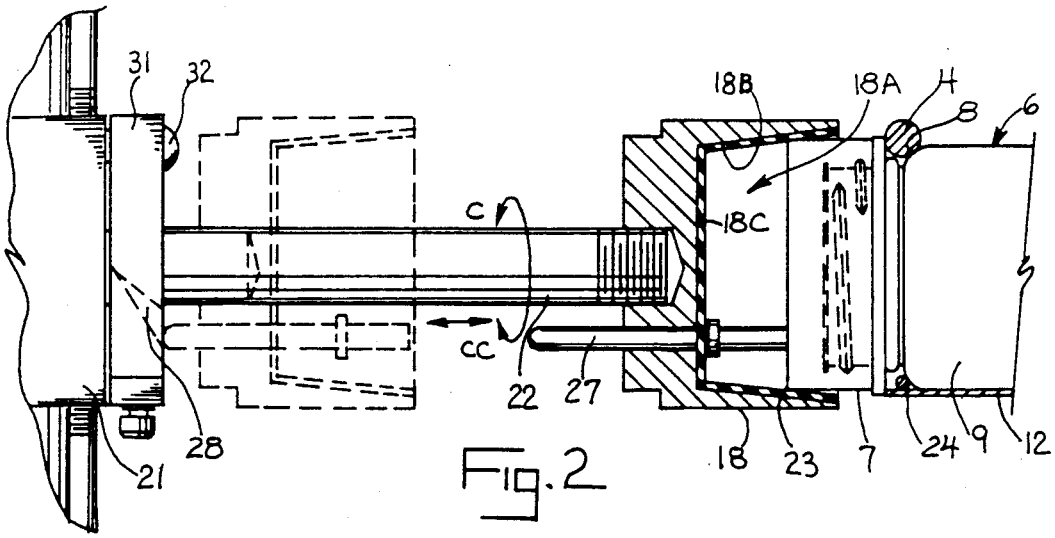
FIG. 2 is a partially sectioned side view of the decapping mechanism.

At the commencement of operation, the sealed container 6 is fed by any conventional and, therefore, not illustrated feed device to a pocket formed by the turntable slot 3 and the stationary support shelf 12 and transported to the cap removal station 17. The sealed container 6 is received in a horizontal position in the pocket formed by the stationary shelf 12 and the turntable slot 3 with the capped end of the sealed container facing away from the axis of rotation of the turntable 2. The sealed container 6 is adapted to slide on the upwardly facing surface of the shelf 12 between stations. When the sealed container 6 is properly aligned with the cap removal station 17, the control unit 90 will cause the cap removal station 17 to commence the unpackaging of the sealed container 6. As shown in FIG. 2, the cap removal station 17 comprises a generally cup-shaped chuck 18 connected to a Pick and Place actuator 21 by a shaft 22. The cup-shaped chuck 18 has an outwardly opening recess 18A formed by internally facing side wall 18B and a bottom wall 18C. The Pick and Place actuator 21 is of the kind made by Rotomation Incorporated and capable of imparting a reciprocating linear movement of the chuck 18 to and from the turntable 2 and a simultaneous rotary movement of the chuck 18 through a 540 degree arc.

Figure 3:
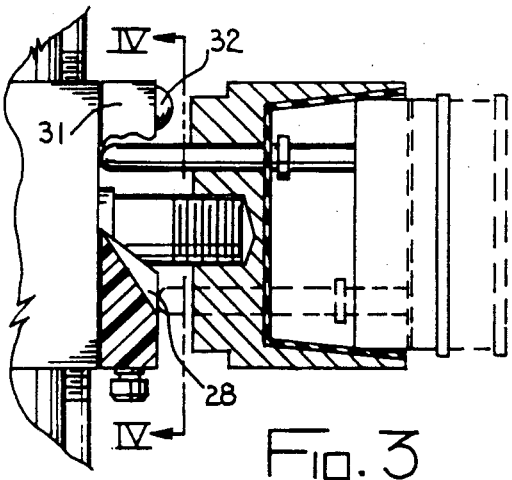
FIG. 3 is a partially sectioned side view of the cap ejecting mechanism.

The chuck 18 may be made of any suitable material, such as a metal, and is threaded onto the actuator shaft 22 and the recess 18A sized so as to frictionally engage the outside surface of a cap 7 on the sealed container 6. The actuator shaft 22 directs an elastomeric lining 23, such as rubber, provided on the inside surfaces of the recess 18A of the chuck 18, into engagement with the outer surface of the cap 7 and pushes the sealed container 6 against the back shim 10 to facilitate the unscrewing operation. This movement also unlocks the cap by first pushing it toward the bottom wall of the container 6. The control unit 90 effects an actuation of the rotary actuator shaft 22 to turn the chuck 18 counterclockwise through a 540 degree arc while simultaneously withdrawing from the sealed container and thereby unscrews the cap 7 from the sealed container 6. As shown in FIGS. 2 and 3, the chuck 18 has a floating pin 27 extending through the bottom wall 18C. This pin 27 is pushed rearward, that is, radially outwardly from the turntable 2, by the top surface of the cap 7 as the chuck engages and removes the cap 7 from the sealed container.

Figure 4:
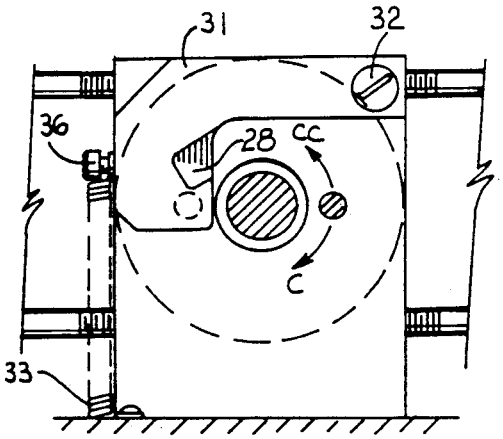
FIG. 4 is a sectional view of the cap ejection mechanism of FIG. 3 taken along the line IV—IV.

The actuator shaft 22 then retracts linearly to its initial starting position and the control unit 90 then causes the chuck 18 to rotate 540 degrees in a clockwise direction C in FIG. 4. As the chuck 18 rotates, the pin 27 engages a pivotally supported arm 31 biased against a not shown stop by a spring 33. As shown in FIG. 4, the arm 31 pivots about pivot pin 32 and is lifted up and away from the not shown stop by the pin 27 during the 540 degree rotation of the chuck 18 against the force of the tension spring 33. After the pin 27 has cleared the arm 31, the spring 33 returns the arm 31 to its rested position against the not shown stop.

The control unit 90 then causes a reversal in the direction of rotation of the chuck 18, that is, it is rotated 540 degrees in a counterclockwise CC (FIG. 4) direction. As the chuck 18 rotates in the counterclockwise direction, the pin 27 is brought into contact with a cammed surface 28 on arm 31. As shown in FIG. 3, the pin 27 is pushed forward that is, toward the turntable 2, by the cammed surface 28 during the counterclockwise rotation of the chuck 18 and against the top surface of the cap 7 to eject the cap from the chuck 18. The ejected cap 7 falls along a chute 37 (FIG. 1) into a receptacle (not shown). After the chuck 18 completes its 540 degree counterclockwise rotation, the cap removal station 17 is ready to decap the next sealed container 6.

Figure 5:
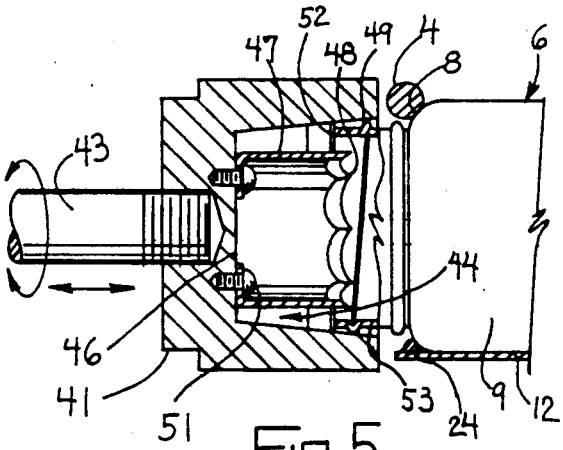
FIG. 5 is a partially sectioned side view of the seal perforating mechanism.

After the cap 7 has been removed from the sealed container 6, the control unit 90 then causes the turntable 2 to move the sealed container 6 along the stationary support shelf 12 to the seal rupturing station 38. The seal rupturing station 38 comprises a cup-shaped chuck 41 threaded onto a shaft 43 of a further Pick and Place actuator 42. As shown in FIG. 5, a circular knife 47 having a plurality of extended knife edges 48 is concentrically oriented within the recess 44 in the chuck 41 and affixed to the bottom wall 46 of the chuck by screws 51. The chuck 41 is sized to fit over the neck 9 of the sealed container 6 and engage with cap threads 49 on the neck 9 for purposes of centering the neck 9 of the container within the recess 44. The circumference of the circular knife 47 is sized so as to fit within the neck 9 of the sealed container 6. The actuator 42 is capable of imparting a reciprocating linear movement of the chuck 41 to and from the turntable 2 and rotary movement of the chuck 41 through 90 degrees.

After the sealed container 6 is aligned properly with the chuck 41, the shaft 43 of the actuator 42 is extended toward the sealed container 6 to a position where the plurality of extended knife edges 48 perforate a seal 52 contained within the container neck 53. Thereafter, the actuator 42 rotates the chuck 41 through 90 degrees, thereby accomplishing a circular cut of the seal 52. The actuator 42 then withdraws the chuck 41 from around the container neck 53 leaving the cut seal 52 contained therein.

Guide rails 4 and 24 are provided around the periphery of the turntable 2 and the stationary shelf 12 respectively for controlling the position of the container 6 within the turntable slots 3 during the various unpackaging operations. The guide rail 4 is positioned so as to make contact with a ridge 8 formed at the juncture of the container body 9 with the container neck 53 and is supported by brackets 5 attached to the supporting structure 16. The guide rail 4 is provided above the turntable slots 3 so as to engage the container body ridge 8 as the sealed container 6 moves under the guide rail 4 during its movement through the various unpackaging operations. The guide rail 24 is affixed to the upper peripheral surface of the stationary shelf 12 by a suitable method, such as welding, and is positioned so as to make contact with the ridge 8 formed at the juncture of the container body 9 with the container neck 53. The guide rail 24 is provided below the turntable slots 3 so as to engage the container body ridge 8 as the sealed container 6 moves over the stationary shelf 12.

Figure 6:
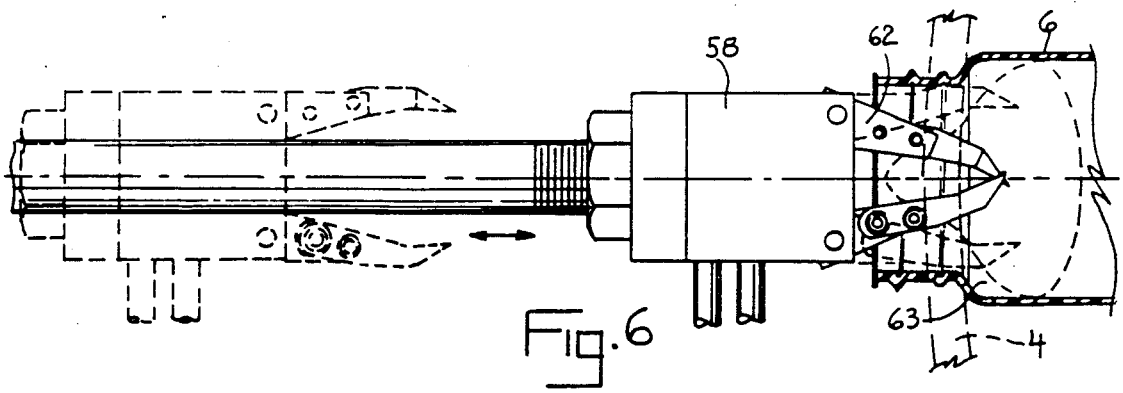
FIG. 6 is a partially sectioned side view of the seal and cotton wad removal mechanism.

After the cutting of the seal 52, the control unit 90 causes the indexing drive unit 13 to index 45 degrees to move the container to a station where the cut seal 52 and a cotton wad 63 is removed from the container. The seal and cotton wad removal station 56 comprises a linear actuator 57 having a shaft 61 with a gripper 58 affixed to its end. The gripper 58 comprises a pair of pincer jaws 62 which are capable of being inserted into the container neck 53 in their open position. As shown in FIG. 6, the actuator 57 is capable of reciprocating linear movement of the gripper 58 to and from the turntable 2 and positioning the gripper 58 within the neck 53 of the container so as to permit the pincer jaws 62 to close and clamp down on the cut seal 52 and the cotton wad 63.

After control unit 90 causes the pincer jaws 62 to close and clamp down on the cut seal 52 and the cotton wad 63, the actuator shaft 61 withdraws the gripper 58 from inside the container neck 53 to its initial starting position. Thereafter, the control unit 90 causes the pincer jaws 62 to open. The control unit 90 then activates a valve (not shown) to cause a blast of air to be delivered from a blower pipe 66 (FIGS. 7 and 8) to blow the cut seal 52 and the wad of cotton 63 from the pincer jaws 62 and against a back screen 73 of a cotton wad and seal receptacle 67.

Figure 7:
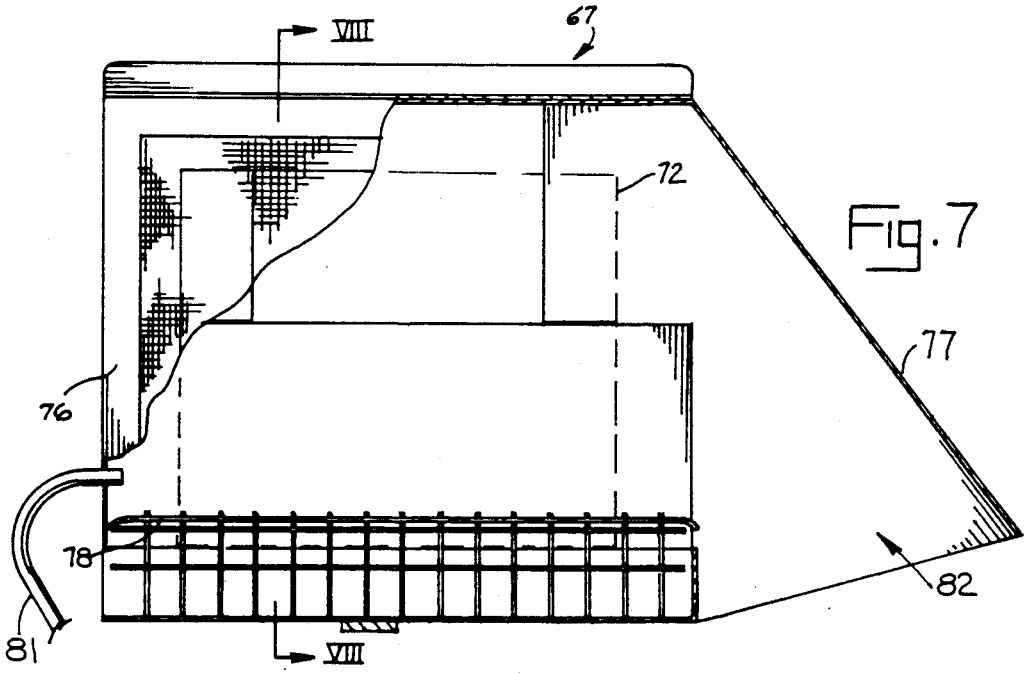
FIG. 7 is a partially cut-away rear view of the cotton wad and seal receptacle.
Figure 8:
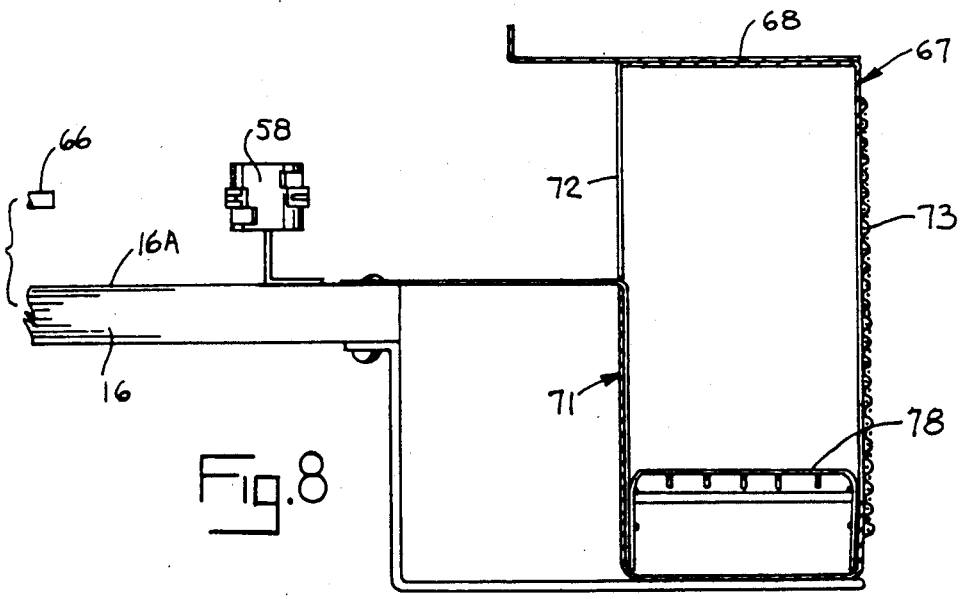
FIG. 8 is a sectional view of the seal and the cotton wad receptacle of FIG. 7 taken along the line VIII—VIII.

As shown in FIGS. 7 and 8, the cotton wad and seal receptacle 67 comprises a boxlike structure having a vertically disposed back screen 73, a first flat planar sidewall 76, a second sidewall 77 opposite the side 76, a bottom grid 78 and a front side 71 having an opening 72 provided therein. A space exists between the bottom edge of the sidewall 77 and the end of the grid 78 to define an opening 82.

The cotton wad 63 and the cut seal 52 fall from the back screen 73 onto the bottom grid 78 where, in response to the control unit 90 activating a not shown valve, air is jetted out of a second blower pipe 81 to propel the cut seal 52 and the cotton wad 63 toward the second sidewall 77 and out through the opening 82 into a not shown waste receptacle, such as a bag provided beneath the opening 82.

Figure 9:
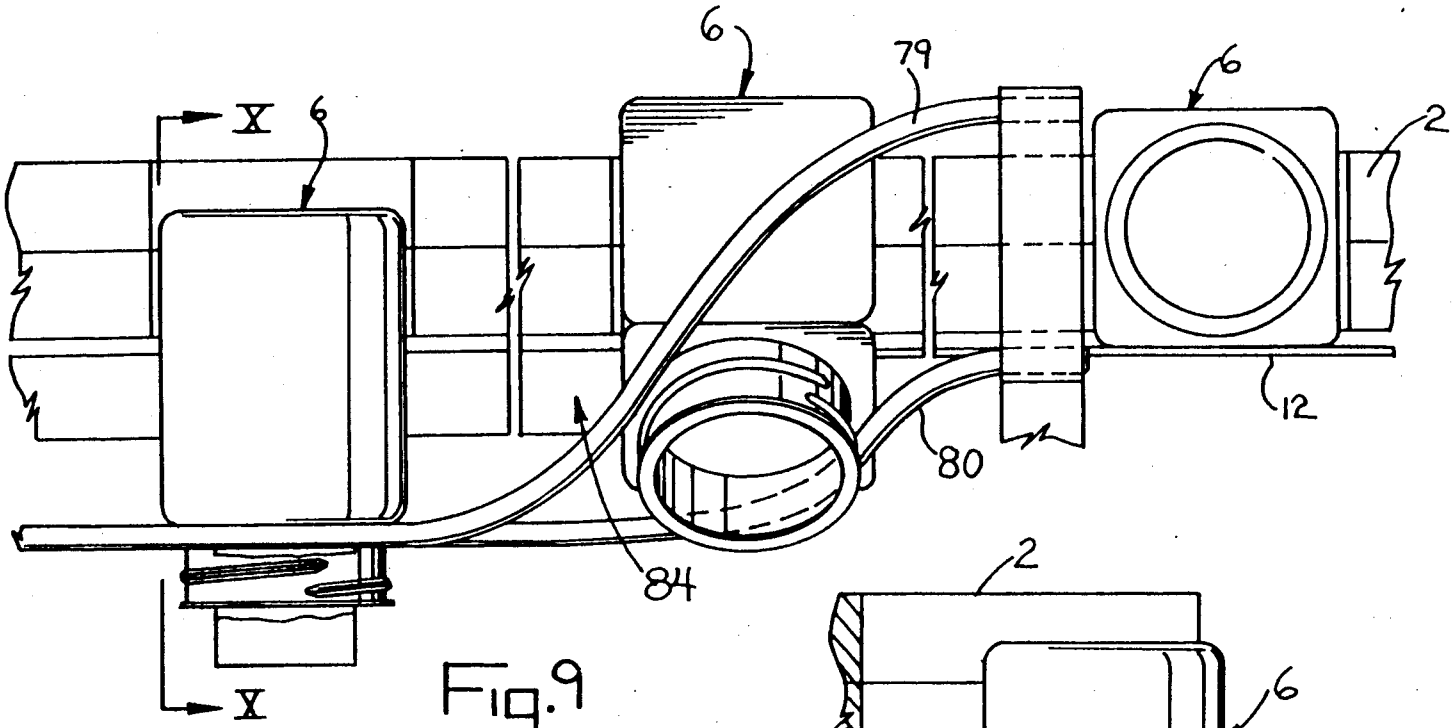
FIG. 9 is a left side view of FIG. 1 illustrating the emptying cycle of the present invention.
Figure 10:
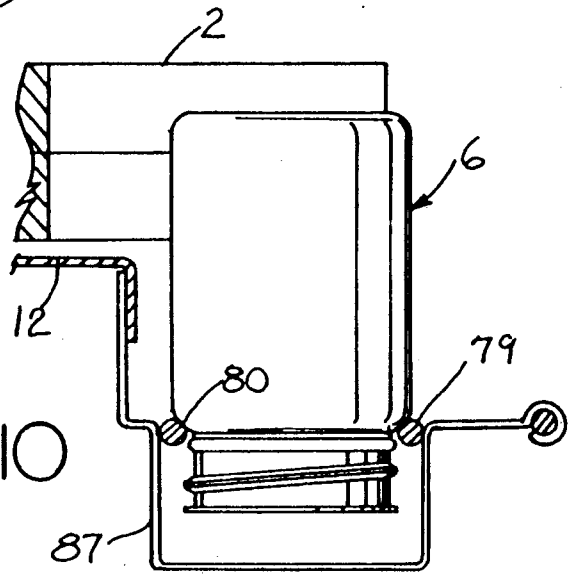
FIG. 10 is a sectional view taken along the line X—X of FIG. 9.

After the cotton wad 63 and the cut seal 52 are removed from the container, the turntable 2 advances the container to a location where the contents of the container are emptied. As shown in FIGS. 1 and 9, clockwise from the seal and cotton wad removal station 56, a pair of further guide rails 79 and 80 curve downwardly while the support shelf 12 is gradually cutaway or bent downwardly away as at 84 from underneath a container so as to gradually cause the container to become inverted, i.e. oriented upside down. In this position, the container is supported only by its sliding contact with the guide rails 79 and 80 against the container body ridge 8 and is urged along the guide rails by the balance of the container 6 still being oriented in the pocket 3, as shown in FIGS. 9 and 10. The guide rails 79 and 80 are supported by brackets 87 secured to the shelf 12 as by any convenient and not illustrated means.

A receptacle (not shown) is provided underneath the inverted container and collects the contents of the container as the turntable carries the container through the dumping cycle. An alarm mechanism, such as a weight sensitive device, may be connected to the receptacle for the contents of the container in order to ensure that the container is being emptied properly.

After the container has passed clockwise through the dumping state, the guide rail 79 is removed from supporting the container body ridge 8 which enables the emptied container to fall from the turntable 2 into a further disposal receptacle (not shown).

In the unpackaging machine 1 illustrated in FIGS. 1–8, all of the actuators are pneumatically operated and hoses 86 are used to transport air to and remove air from the various actuators. The control unit 90 is a conventional programmable unit, such as an Allen Bradley SLC-100 programmable controller, to effect a sequential activation of the various actuators so that the multitude of processes can occur sequentially and simultaneously. It is completely within the scope of the present invention to substitute mechanical or electronic actuators for the various pneumatic actuators described above.

OPERATION

The unpackaging machine of the present invention operates as follows. A sealed container 6 is horizontally received into a pocket formed by an open slot 3 in the turntable 2 and the upwardly facing surface of the stationary bottom support shelf 12, and transported by the rotation of the turntable 2 to a station where the cap is removed. The sealed container may be queued into the pocket formed by the turntable 2 and the support shelf 12 by a conveying device such as a belt conveyor or any other suitable delivery mechanism. However, the sealed container 6 must be delivered to the pocket with its capped end directed outward from the turntable's axis of rotation.

At the cap removal station 17, the actuator 21 advances the shaft 22 having a chuck 18 thereon, which chuck frictionally engages the container cap 7 and unscrews it from the container. Thereafter, the chuck is withdrawn to its original starting position. The cap 7 is ejected from the chuck 18 and falls down a chute 37 into a first disposal receptacle (not shown).

The container without cap is then advanced by the turntable 2 to a seal rupturing station 38 where the actuator 42 effects a movement of the shaft 43 and the chuck 41 threaded onto the end of the shaft 43 toward the seal to rupture the seal 52 contained within the container neck 53. A circular knife 47 having a plurality of extended knife edges 48 is contained within the chuck 41 and brought in contact with the seal 52. The actuator 42 thereafter rotates the chuck 41 through 90 degrees which results in a circular cut being made in the seal 52, which is usually of a thin foil material. After the cut is made, the actuator 42 withdraws its shaft 43 to its starting position and leaves the cut seal 52 contained inside the container neck 53. A new capped container is, in the meantime, fed into the next following pocket on the turntable 2 and continues in this manner with each indexing movement of the turntable. The second container is simultaneously uncapped while the first container is having its seal ruptured.

The first container is then advanced to the seal and cotton wad removal station 56, while the second container and a new third container are moved to the seal rupturing and uncapping stations, respectively, by the turntable 2 where the actuator 57 having a shaft 61 and a gripper 58 is used to remove the cut seal 52 and cotton wad 63 contained within the container. The actuator 57 advances the shaft 61 toward the container where a pair of pincer jaws 62 is inserted inside the neck 53 of the container. The pincer jaws 62 are actuated to close around the cut seal 52 and cotton wad 63 contained in the container neck 53 and then the shaft 61 withdraws the pincer jaws 62 with the cotton wad 63 and the cut seal 52 from the container. The gripper 58 is retracted to its starting position and the pincer jaws 62 are opened. A blast of air from a blower pipe blows the cotton wad 63 and the cut seal 52 against a back screen 73 of a receptacle 67. The cotton wad 63 and the seal 52 falls from the back screen 73 to a bottom grid 78 where a second blast of air from a second blower pipe 81 blows the cotton wad 63 and the seal 52 off the bottom grid 78 into a second not shown waste receptacle.

As the turntable 2 advances the container further, guide rails 79 and 80, in combination with the gradual absence of the support shelf 12 as at 84, cause the container to be turned into a downwardly facing position, i.e. upside down, so as to allow the contents of the container to be emptied into a third not shown receptacle.

After the contents have been emptied, the guide rails 79 and 80 terminate and, as the turntable 2 continues to be indexed, the now empty and upside down containers will no longer be supported by the guide rails 79 and 80 and will be allowed to fall into a fourth not shown trash receptacle. The empty slot 3 is then ready to receive another sealed container 6.

It is understood that the above-described arrangement is merely illustrative of many possible specific embodiments which represent the present invention. Numerous and varied other arrangements can be readily devised without departing from the spirit and scope of the present invention.

The embodiments of the invention in which an exclusive property or privilege is claimed are defined as follows:

1. An unpackaging machine for removing the contents from a sealed container comprising:

means for receiving and transporting said sealed container;

means for removing a cap from said sealed container;

rotatable cutting means for rupturing a seal on said sealed container;

means for removing a cotton wad and said ruptured seal from said container;

means for emptying said contents from said container; and means for discharging the emptied container.

2. The unpackaging machine according to claim 1, including a control means for facilitating a coordinated and continuous sequential operation of each of said means on a container.

3. The unpackaging machine of claim 1, wherein said means for removing said cap comprises means for grasping and unscrewing said cap.

4. The unpackaging machine of claim 3, wherein said means for grasping and unscrewing said cap is capable of reciprocating movement in a horizontal direction.

5. The unpackaging machine of claim 4, wherein said means for grasping and unscrewing said cap comprises means for ejecting said cap after said cap has been removed from said sealed container.

6. The unpackaging machine of claim 4, wherein said rotatable cutting means is capable of reciprocating movement in a horizontal direction.

7. The unpackaging machine of claim 1, wherein said means for removing said cotton wad and seal comprises means for grasping said cotton wad and seal.

8. The unpackaging machine of claim 7, wherein said means for grasping said cotton wad and seal is capable of reciprocating movement in a horizontal direction.

9. The unpackaging machine of claim 1, additionally comprising blowing means for disengaging said cotton wad and seal from said means for removing said seal and cotton wad.

10. The unpackaging machine of claim 1, wherein said means for emptying said contents from said container comprises means for inverting said container.

11. An unpackaging machine for removing the contents from a sealed container comprising:

a turntable for receiving and transporting said sealed container, said turntable having an axis of rotation extending in a vertical direction; means for grasping and unscrewing a cap from said sealed container, said grasping and unscrewing means comprising means for ejecting said cap after said cap has been removed from said sealed container and being capable of reciprocating movement in a horizontal direction; rotatable cutting means for rupturing a seal on said sealed container, said rotatable cutting means being capable of reciprocating movement in a horizontal direction; means for grasping and removing a cotton wad and said seal from said container, said means for grasping and removing said cotton wad and seal being capable of reciprocating movement in a horizontal direction; blowing means for disengaging said cotton wad and seal from said means for grasping and removing said cotton wad and seal; means for inverting said container to empty the contents therefrom; and means for discharging the emptied container from said turntable.

12. The unpackaging machine according to claim 11, including a control means for facilitating a coordinated and continuous sequential operation of each of said means on a container.

13. The unpackaging machine of claim 12, additionally comprising a vertically disposed grid means for receiving the disengaged cotton wad and seal.

14. The unpackaging machine of claim 13, additionally comprising a second blowing means for removing said cotton wad and seal from said vertically disposed grid means.

15. The unpackaging machine of claim 11, wherein said means for grasping and unscrewing said cap comprises a chuck having a movable pin contained in a base portion thereof.

16. The unpackaging machine of claim 15, additionally comprising a cam means for engaging said movable pin and ejecting said cap from said socket.

17. The unpackaging machine of claim 11, wherein said means for grasping said cotton wad and seal comprises a pair of pincer jaws.

18. The unpackaging machine of claim 11, wherein said means for inverting said container comprises guide rail means for engaging an upper and lower, outer surface of said container and supporting said container thereby during the emptying of said contents from said container.

19. The unpackaging machine of claim 11, wherein said turntable contains a plurality of slots therein for receiving said sealed container.

* * * * *

UNITED STATES PATENT AND TRADEMARK OFFICE

CERTIFICATE OF CORRECTION

PATENT NO. : 4,988,255

DATED : January 29, 1991

INVENTOR(S) : Dalyn C. HOFFMAN

It is certified that error appears in the above-identified patent and that said Letters Patent is hereby corrected as shown below:

Column 8, line 1; change "4" to ---1---.

line 43; change "12" to ---11---.

Signed and Sealed this

Twenty-second Day of September, 1992

*Attest:*

DOUGLAS B. COMER

*Attesting Officer*

*Acting Commissioner of Patents and Trademarks*